US009534387B2

(12) United States Patent
Anguelov

(10) Patent No.: US 9,534,387 B2
(45) Date of Patent: Jan. 3, 2017

(54) STRUCTURAL ELEMENT, STRUCTURE COMPRISING A STRUCTURAL ELEMENT AND USE OF SAID STRUCTURAL ELEMENT

(75) Inventor: Valentin Zdravkov Anguelov, Leiden (NL)

(73) Assignee: VIZIONZ HOLDING B.V., 'S-Gravenhage (NL)

( * ) Notice: Subject to any disclaimer, the term of this patent is extended or adjusted under 35 U.S.C. 154(b) by 738 days.

(21) Appl. No.: 13/320,422

(22) PCT Filed: May 15, 2009

(86) PCT No.: PCT/EP2009/055920

§ 371 (c)(1),
(2), (4) Date: Nov. 14, 2011

(87) PCT Pub. No.: WO2010/130294

PCT Pub. Date: Nov. 18, 2010

(65) Prior Publication Data

US 2012/0060958 A1 Mar. 15, 2012

(51) Int. Cl.

| | |
|---|---|
| ***E04C 3/28*** | (2006.01) |
| ***E04C 3/29*** | (2006.01) |
| *E04C 3/04* | (2006.01) |

(52) U.S. Cl.

CPC . *E04C 3/28* (2013.01); *E04C 3/29* (2013.01); *E04C 2003/043* (2013.01); *E04C 2003/0421* (2013.01); *E04C 2003/0447* (2013.01); *E04C 2003/0486* (2013.01); *Y10T 29/49826* (2015.01)

(58) Field of Classification Search

CPC ..... E04C 3/10; E04C 2003/043; E04C 3/28; E04C 3/29; E04C 2003/0421; E04C 2003/0447; E04C 2003/0486; E04B 2001/1939

USPC ..... 138/93, 103; 52/2.11, 2.13, 2.18, 2.22, 52/2.23

See application file for complete search history.

(56) References Cited

U.S. PATENT DOCUMENTS

| | | | | |
|---|---|---|---|---|
| 4,325,654 | A * | 4/1982 | Meckler | 405/196 |
| 4,956,947 | A * | 9/1990 | Middleton | E04H 9/14 52/1 |
| 6,192,633 | B1 * | 2/2001 | Hilbert | 52/2.18 |
| 6,260,306 | B1 * | 7/2001 | Swetish | E04H 15/20 135/124 |

(Continued)

FOREIGN PATENT DOCUMENTS

| | | |
|---|---|---|
| CA | 2133788 | 4/1996 |
| DE | 1175412 | 8/1964 |

(Continued)

OTHER PUBLICATIONS

International Search Report and Written Opinion in International Application No. PCT/EP2009/055920 mailed Jan. 29, 2010, 15 pages.

*Primary Examiner* — Patrick M Buechner
(74) *Attorney, Agent, or Firm* — Thomas | Horstemeyer, LLP

(57) ABSTRACT

The invention relates to a structural element. In an embodiment, the structural element includes a stiff, elongate tubular member, wherein an inner surface of the tubular member and side faces enclose a core extending along at least a length of the tubular member, wherein the core is provided with a fluid under pressure. The invention furthermore relates to a method for hoisting a stiff, elongate tubular member.

16 Claims, 12 Drawing Sheets

(56) References Cited

U.S. PATENT DOCUMENTS

| | | | | |
|---|---|---|---|---|
| 6,484,469 | B2 * | 11/2002 | Drake | 52/649.2 |
| 2003/0019515 | A1 * | 1/2003 | Fritzche et al. | 135/121 |
| 2008/0116018 | A1 * | 5/2008 | Wieland | A63G 31/12 187/401 |
| 2009/0072426 | A1 * | 3/2009 | Regan | 264/45.3 |
| 2010/0163683 | A1 * | 7/2010 | Quine | 244/158.5 |

FOREIGN PATENT DOCUMENTS

| | | |
|---|---|---|
| DE | 3137584 | 4/1983 |
| DE | 19712350 | 10/1998 |
| DE | 29821061 | 6/1999 |

* cited by examiner

STRUCTURAL ELEMENT, STRUCTURE COMPRISING A STRUCTURAL ELEMENT AND USE OF SAID STRUCTURAL ELEMENT

CROSS-REFERENCE TO RELATED APPLICATION

This application is the National Stage of International Application No. PCT/EP2009/055920, filed May 15, 2009, the contents of which are incorporated by reference as if fully set forth herein.

TECHNICAL FIELD

The present invention relates to a structural element, a structure comprising at least one structural element, the use of said structural element and a method for hoisting a device.

BACKGROUND

In various industries use is made of structural elements for instance in the form of tubular members. These members are typically manufactured from metal or plastics. The combination of the material and the tubular shape provide structural rigidity to said elements. These elements are furthermore relatively cheap to produce.

By using a plurality of interconnected structural elements it is possible to manufacture a building structure with limited costs while still providing a high rigidity for said structure. This principle is for instance used to manufacture bridges, oil rigs, cranes and other structures having beam-like building elements.

SUMMARY

It is an object of the present invention to improve the known structural element.

In order to accomplish that objective, the structural element according to the invention comprises a stiff, elongate tubular member, wherein an inner surface of said tubular member and side faces enclose a core extending along at least a length of said tubular member, wherein said core is provided with a fluid under pressure. Although a conventional structural element already has load-bearing capacities due to its stiffness, the load-bearing capacity of the structural element according to the invention is increased significantly by providing a fluid under pressure in the tubular member of the structural element. The fluid is held in the core, a space enclosed by side faces and the inner surface or wall of the tubular member. Preferably the core comprises the inner space of a hollow tubular member. The side faces are arranged to specify a predetermined length of said core.

Preferably the tubular member is substantially circular in cross-section. This increases the strength of the structural member. The tubular member is furthermore preferably manufactured from a stiff material, i.e. a material showing structural integrity. Suitable materials are for instance metal, carbon fibre, raisins and/or plastics. More preferably the structural element comprises a steel tube, for instance stainless steel.

It should be noted that the term fluid as used herein can be interpreted as both a gas and a liquid. It is therefore possible to fill the core of said elongate tubular member with a gas and/or liquid under pressure. The core preferably encloses the fluid air- and/or watertight, holding the fluid substantially stationary in the core.

With the term a fluid under pressure is meant that the pressure of the fluid in the core is higher than the pressure of the fluid surrounding the structural element, for instance atmospheric air or water the element is placed in. The fluid inside the tubular member, in particular in the core, is therefore in overpressure with respect to the exterior of the structural element.

Preferably the fluid in the core has a pressure in the range from 0 Pa to a pressure to attain the maximum allowable circumferential stress of the tubular member, more preferably the fluid has a pressure of approximately half of said pressure attaining maximum circumferential stress. Test and calculations indicated that this results in a significantly stronger structural element.

As an example, the pressure attaining the maximum allowable circumferential stress for a tubular member from steel S355 with a wall thickness of 12.5 mm and a radius of 250 mm is 11 MPa. However, it is preferred to provide a pressure in the core of between 5 to 8 MPa. The maximum pressure for the same tubular member manufactured from Polyamid 6 is 2 MPa. A pressure of 1-1.2 MPa is however preferred.

According to a preferred embodiment of the structural element according to the invention, the core extends along substantially the whole length of the tubular member. Along substantially the whole length of the structural element in the form of a tubular member, said element is filled with the fluid under pressure. The side faces enclosing the core are hereby preferably formed by the end faces of the tubular member. This results in a simple construction.

It is however also possible to provide only a predetermined length of the structural element with the fluid under pressure. According to a further preferred embodiment, said side faces comprise at least one removable plug. The faces enclosing the core, or for instance a plurality of cores, can then be placed accordingly along the length of the element. Preferably the core or cores provided with fluid under pressure extend along lengths of the structural element which encounter the highest loads.

Preferably said plug is movable between a first position wherein the outer diameter of said plug is smaller than the inner diameter of the tubular member and a second position wherein the outer diameter of said plug and the inner diameter of the tubular member are substantially equal. In the first position, the plug is movable in the tubular member allowing efficient placement of said plug. After proper placement, the plug is moved to the second position. The outer diameter of the plug now corresponds to the inner diameter of the inner surface of the tubular member, keeping the plug in place. The plug can now function as side face for the core. More preferably the plug comprises at least one inflatable tubular member, wherein inflating said member moves the plug from the first to the second position and vice versa.

According to a further preferred embodiment said fluid extends along substantially the whole inner surface of said element. The fluid hereby exerts pressure to substantially the whole inner surface of the tubular member of the structural element. Preferably the fluid extends along substantially the whole inner surface along the inner diameter in the radial plane of the elongate member. The fluid hereby exerts pressure to the whole inner surface in a radially outwardly direction. In case the core extends along substantially the whole length of the tubular member, said fluid also extends along substantially the whole inner surface in the axial direction of the elongate member.

According to a further preferred embodiment of the structural element according to the invention, said core is provided with at least one compartment. A compartment can hereby function as filler, reducing the amount of fluid under pressure in the core. The compartment can furthermore prevent an explosion in case of leakage of said fluid, in particular a fluid in the form of gas. Preferably the compartment extends coaxial in the elongate tubular member, wherein the core provided with the fluid under pressure extends adjacent the inner surface of the tubular member. The compartment is preferably manufactured from a material capable of withstanding the pressure exerted by the core. Suitable materials are for instance plastic or metal.

It is however also possible to provide the compartment with a fluid under pressure. When the pressures in the core and the compartment correspond, the resulting pressure on the wall of the compartment decreases. This allows a smaller wall thickness for said compartment. The material of the compartments can then be manufactured from for instance cloth. However, in case of a leak of the core, an increased pressure is exerted on the wall of the compartment. Preferably the pressure in the compartment is approximately half of the pressure in the core. This allows a thin wall of the compartment while preventing rupture of said compartment in case of a leak.

Preferably the compartment is substantially spherical and/or tubular in shape. A spherical compartment preferably has a diameter equal to the inner diameter of the core, allowing a close fit between said compartment and the inner surface of the tubular member. The contact area between the compartment and the inner surface of the tubular member is however small, allowing the surrounding fluid in the core to exert sufficient pressure on the inner surface to ensure in a strong structural element.

A tubular compartment preferably has a diameter smaller than the inner diameter of the inner wall enclosing the core. The tubular compartment hereby preferably extends at a distance from said surface, allowing the fluid to exert pressure on substantially the whole inner surface. The element is provided with suitable holders for holding the compartment in place in the core, preferably coaxial with the core of said element.

It is also possible to use a combination of spherical and tubular compartments in the core.

More preferably said compartment or a plurality of compartments extend along substantially the whole length of said core. This furthermore reduces the amount of pressurized fluid in the core and reduces the danger of explosions in case of leakage of gas, while still providing the pressure to the inner surface of the tubular member.

According to a further preferred embodiment said element is provided with hoisting means, preferably near the outer ends of the element. This for instance allows the structural element to be used as spreader bar for hoisting elongate structures such as pieces of a pipe-line. Suitable hoisting means are for example hooks, lines, chains or a combination thereof.

Preferably at least a length of the structural element in the middle region of said element is provided with a core with fluid under pressure. It is for instance possible to provide a core at said middle region of the tubular member where the maximum stresses normally occur. The core can for instance be formed by side faces in the form of plugs in intermediate locations along the length of the tubular member and the inner surface of said member. The length between said side faces is then provided with a filling under pressure.

According to a further preferred embodiment the structural member is provided with a valve. The valve preferably extends between the core and the outer surface of the tubular member for easy access. This allows the pressure of the fluid in the core to be adjusted. It then possible to adjust the strength of the element to a typical use or environment of said element. It is furthermore possible to adjust the natural frequency and damping of said element. Preferably the structural element is hereto provided with suitable pressure sensors.

Preferably the structural element further comprises a pressure vessel arranged to supply fluid to the core. The pressure vessel functions as a safety measure. In case the pressure drops in the core, additional fluid under pressure can be supplied to the core to maintain the predetermined pressure. More preferably the pressure vessel is located outside the tubular member. It is however also possible to use a compartment in the core as pressure vessel. The valve is then arranged between the compartment and the core.

The invention furthermore relates to a structure comprising at least one structural element according to the invention. This structure has an increased strength and stability (global and local) compared to structures comprising conventional structural elements. According to a preferred embodiment, the structure comprises at least two structural elements, wherein the cores of said elements are interconnected. Connecting the cores provided with fluid under pressure of separate elements allows the pressure to be averages between the elements in case one of the elements experiences a pressure drop or rise due to for instance an increased load or deformation. The connected core of the second element hereby functions as pressure vessel or buffer. Preferably the connection between the cores comprises a valve. This allows the averaging behaviour of the structure to be adjusted. More preferably each structural element comprises a valve. More preferably the structure comprises a controller arranged to control the valves of said structural elements.

According to a further embodiment of the structure according to the invention, the cores of the structural elements are connected to a shared feeding line, wherein the feeding line is connected to a pressure vessel. By controlling the valves to the individual cores, the stiffness, damping and natural frequencies of the individual structural elements can be adjusted. Preferably the structural elements of the structure are provided with suitable pressure sensors for determining the pressure in the cores.

The method of strengthening or damping relates to a structure comprising at least one structural element according to the invention.

It can be a separate member, cluster of members around an important joint, part of the structure in a zone (splash zone etc) or the whole structure.

This structure has an adjustable strength (damping capabilities) in separate directions. It can work as a passive system—the properties of the structure stay constant, or can work as a semi-active system—at time to time to adjust the properties or full-active system—to follow the environmental circumstances and adjust the system to them.

The system can react by changing the pressure (strengthening/weakling of parts) or changing the damping in the system (vessels) or between the structural elements self. This structure has an increased fatigue life (i.e. design life) due to higher mean stress (see Goodman curves). Fatigue life increases also because the increased strength of the structure causes lower deformations i.e. lower stress ranges.

By increase or decrease of the stiffness it can be changed the natural frequency and the structure can avoid the action frequency areas of the waves, wind or currents and hence decrease the stresses and deformations.

Through adjustment of the pressure in separate members they can avoid the VIV (Vortex Induced Vibrations) caused by waves, winds or currents.

The method can be used for new structures or strengthening, design life extension or improve the dynamic behaviour of existing structures. The improvement means low accelerations, smaller deformations and low stress level. It is useful during transport, lifting or other operations some parts of the structures to be temporary strengthened.

Only for mode "full active system" it is necessary the members to be connected in a system by permanent fluid supply lines. For all other modes (semi-active or passive), after filling the lines can be removed. The system can function with or without permanent fluid connections between de elements.

This method can replace the method for filling one structure with grout. If a jacket platform (tubular structure) needs strengthening, the common method now is to insert grout into the braces. Filling with grout has a lot of disadvantages in comparison to the invention:

- Shrinkage of the grout causes lower global buckling stability due to compression mean stress [the invention has only tension stress]
- Degradation of both strength and fatigue performance due to relative movements of the tubulars during the grout setting period (generally the 24 hour period following grout placement);
- In a hollow section, the complete drying of concrete does not take place;
- Due to practical reasons, is not recommended to use grout for hollow sections with sizes smaller than 200 mm;
- Grout doesn't carry part of the axial load for a axial loaded member, it only supports the walls against local buckling; (for the invention—the fluid carry major part of the axial load, not the steel member self);
- The stiffness (eigen frequency) of the structure is constant, it cannot be adjusted to the environmental conditions; (the invention—can be adjusted to all environmental conditions—frequency, height of waves, wind or currents);
- Expensive equipment and operations;
- Cannot be removed if it is necessary.

The invention furthermore relates to the use of a structural element according to the invention as spreader bar for hoisting a device. A conventional spreader bar normally comprises a tubular member provided with hoisting means in the form of slings for attaching the device to be hoisted and slings to for instance a crane. The hoisting capacity of these spreader bars is limited. When heavier and/or larger devices need to be lifted, spreader frames are normally used. Spreader frames are manufactured from a plurality of beam like members to provide sufficient stiffness for hoisting said device. Spreader frames tend to be heavy and expensive. A structural element according to invention at least partially filled with pressurized fluid provides a relatively light spreader bar which has a lifting capacity comparable to the known spreader frames. Using a lighter spreader bar for instance allows the use of lighter crane.

The invention furthermore relates to a method for hoisting a stiff, elongate tubular member according to the invention comprising:

- providing at least one core enclosed by an inner surface of said tubular member and side faces, the core extending along at least a length of the tubular member;
- filling said core with a fluid under pressure;
- providing hoisting means on said tubular member, and;
- hoisting said tubular member with said hoisting means.

By providing side faces, for instance on the ends of the tubular member to be hoisted, an enclosed core is provided. By filling said core with a fluid under pressure, the stiffness and stability of the tubular member is increased. With the method according to the invention it is possible to hoist tubular members of relatively long length without the need for a spreader bar or frame.

Preferably the core extends along at least a length of the middle region of said element between the hoisting means. The middle region of the tubular member normally experiences the highest stresses. The core can be formed by faces, for instance is the form of plugs, provided in intermediate locations in the tubular member. The core between said side faces can then be provided with a fluid under pressure. Preferably the method further comprises providing at least one compartment in said core.

It is however also possible to provide cores at the end regions of the tubular member where the hoisting means are normally provided. The cores are then better accessible. The first side faces of each of the cores can for instance be formed by faces provided on the end of the tubular member, wherein additional faces are provided in intermediate locations along the length of the tubular member, for instance in the form of plugs. The length between said additional faces is thereby not provided with a filling under pressure.

More preferably the method further comprises removing the side faces, for instance in the form of plugs, after hoisting. The tubular member, for instance for a pipe line, can then be installed properly. In case compartments are used, said compartments are removed too.

It should be noted that all the features from the tubular member according to the invention can also be applied to the method for hoisting said member. It is for instance possible to provide the core with a plurality of compartments or to provide a valve and pressure vessel.

BRIEF DESCRIPTION OF THE DRAWINGS

The present invention is further illustrated by the following Figures, which show a preferred embodiment of the device according to the invention, and are not intended to limit the scope of the invention in any way, wherein.

DETAILED DESCRIPTION

In FIG. 1 a structural element 1 according to the invention is shown. The structural member comprises a tubular member in the form of a tube 2 manufactured from stainless steel with a wall thickness of 12.5 mm. The tube 2 has a diameter of 0.5 meter and is 30 meters in length. In order to increase the overall stiffness and the stability of the tube 2, the hollow core 3 of the tube 2 is filled with a fluid, in this case pressurized gas. The gas in the core 3 has a pressure of 7

MPa. The core 3 is enclosed by the inner surface or wall 2*a* of the tube 2 and the end faces 4*a* and 4*b* of the tube 2.

The core 3 shown in FIG. 1 extends along the whole length, in the direction indicated with I, of the tube 2. The gas under pressure in the core 3 therefore exerts pressure on the whole inner surface 2*a* of the tube 2 and the end faces 4*a* and 4*b*, increasing the stiffness and the stability of said tube 2.

Figure 1A:
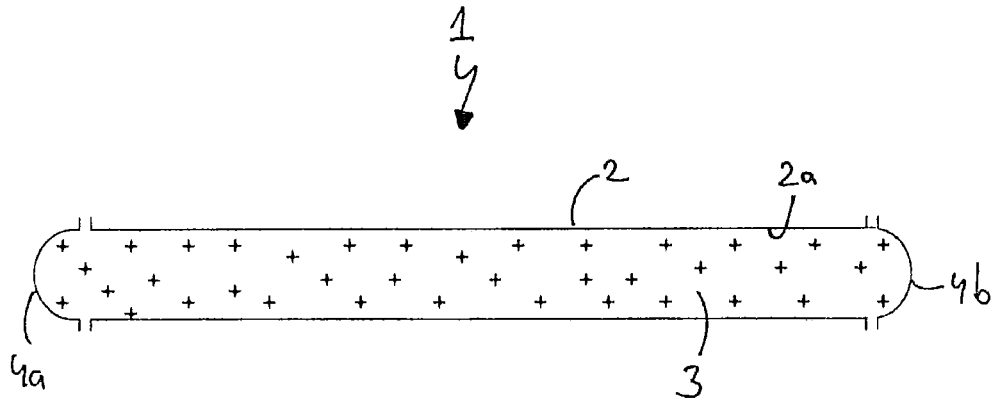
FIGS. 1*a-d* schematically show a first embodiment of the structural element according to the invention in cross-section.
Figure 1B:
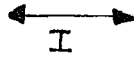
Figure 1B:
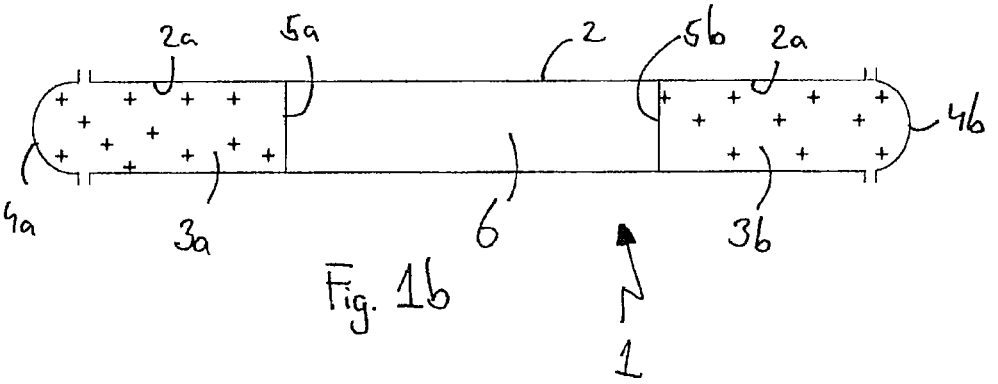

In FIG. 1*b* an alternative of the tube 2 is shown, wherein the tube 2 comprises two cores 3*a*, 3*b*. The first core 3*a* is enclosed by a first face in the form of an end face 4*a* and a second face in the form of an intermediate face 5*a*. The second core 3*b* is formed accordingly with side faces 4*b* and 5*b*. The space 6 between the cores 3*a* and 3*b* does not contain fluid under pressure.

Although the cores do not extend along the whole length of the tube 2, the gas in the cores 3*a* and 3*b* do exert pressure on the whole inner surface 2*a* along the lengths of said cores 3*a* and 3*b*. In the radial plane perpendicular to the axis of the tube 2, the gas exerts a pressure directed radially outwardly on the whole inner diameter of surface 2*a*. An axial pressure is furthermore exerted on side faces 4*a*, 5*a* and 4*b*, 5*b*. The stiffness and stability of the tube 2 is hereby improved with respect to conventional tubes for use in for instance construction.

Figure 1C:
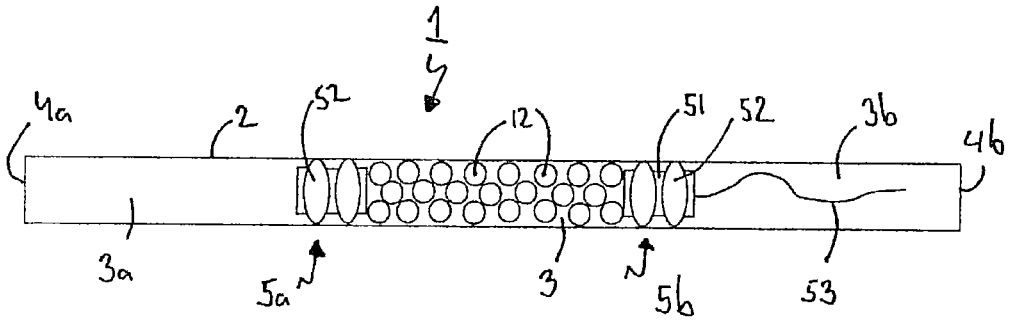

For hoisting a tube 2 it is advantageously to provide at least a length of the tube in the middle region of the tube 2 with a core 3 as shown in FIG. 1*c*. When hoisting, the highest stresses occur in said middle region. The tube 2 can hereto be provided with hoisting means in the form of slings 7 as for instance shown in FIG. 2.

Prior to hoisting, the core 3 is provided using side faces 5*a* and 5*b*. In this example, the side faces 5*a* and 5*b* are in the form of plugs. The plugs comprise a body 51 and inflatable tubular members 52. For placement of the plugs, the tubular members 52 are deflated, allowing easy placement of said plugs in the tube 2. When the plugs are in place, the members 52 are inflated, sealing the core 3. The core 3 can then be provided with a fluid under pressure. In this example also end faces 4*a* and 4*b* are provided. The regions indicated with 3*a* and 3*b* are however not filled with a fluid under pressure.

Figure 2:
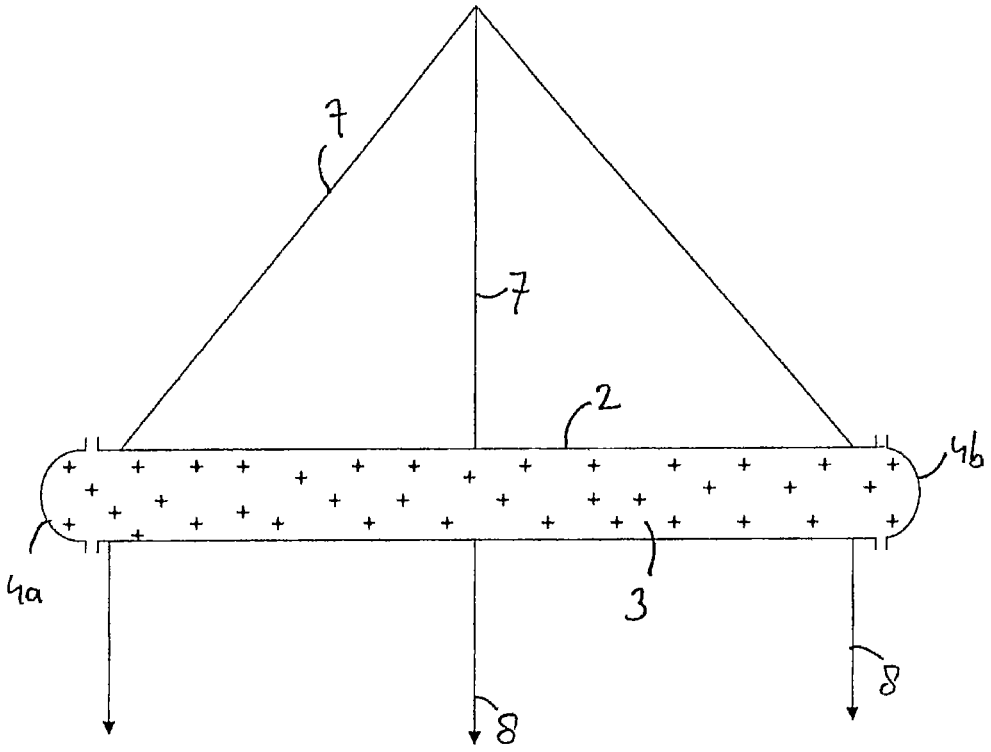
FIG. 2 schematically shows a spreader bar according to the invention in cross-section.

After correct placement of the tube 2 by hoisting, the plugs 5*a* and 5*b* can be removed using lines 53 and the tube 2 can for instance be incorporated in a pipe-line after removal of faces 4*a* and 4*b*. It is for instance also possible to provide a core 3 prior to hoisting which extends along the whole length of the tube 2 as shown in FIG. 2.

Figure 1D:
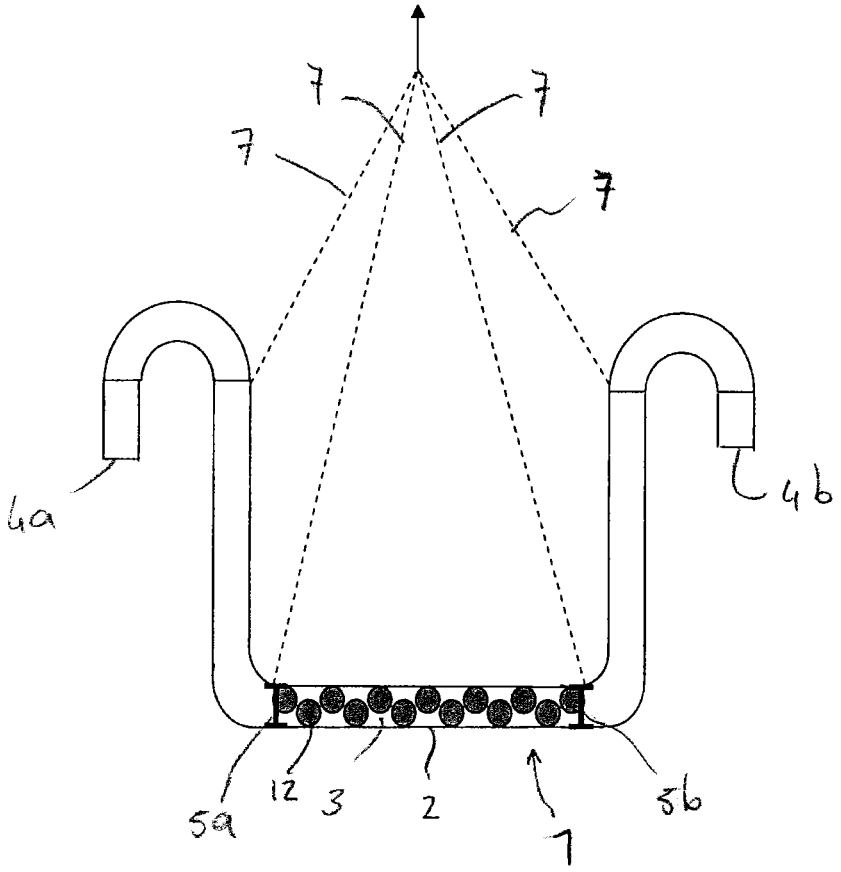

FIG. 1*d* shows an alternative embodiment of the tube 2 as shown in FIG. 1*c*. Instead of a straight tube 2 as shown in FIG. 1*c*, the tube 2 may have tube ends with end faces 4*a*, 4*b* which are single bended or curved in multiple directions. The tube 2 has hollow tube ends which are curved.

A middle region of the tube 2 extends in a lateral direction. Here, the lateral direction is a horizontal direction. The tube ends extend in an upwards direction. At least a length of the tube 2 in the middle region of the tube 2 has a core 3. The core is provided with a plurality of compartments in the form of inner tubes 12 which extend in the core 3. The core 3 is enclosed in between a first intermediate face 5*a* and a second intermediate face 5*b*. When hoisting, the highest stresses occur in said middle region. In particular, the middle region is vulnerable to deformations. For that reason the tube 2 is reinforced in the middle region.

At least one sling 7 is provided for hoisting the tube 2. As illustrated, four slings 7 are connected to the tube 2 and at a central point connected to each other. Two slings 7 are connected at the outer tube ends and two slings are connected at the intermediate faces 5*a*, 5*b* of the structural element. Herewith, the structural element can be hoisted in a stable manner and a risk on unallowable bending may be prevented.

In FIG. 2 the structural element comprising the tube 2 is used as a spreader beam. The tube 2 is hereto provided with hoisting means in the form of slings 7 for connection to a crane (not shown). Slings 8 are furthermore provided to be attached to the device or structure to be hoisted. The spreader beam according to the invention is cheap to manufacture and light, allowing heavier loads to be lifted with relative small cranes.

As an example, a conventional spreader bar a diameter of 508 mm and a wall thickness of 12.5 mm manufactured from steel is capable of lifting a structure of 16 tons with a length of 18 meters. In contrast, the spreader bar according to the invention is capable of lifting a structure weighing 16 tons of at least 30 meters in length. Although a conventional spreader frame is capable of lifting the same structure as the spreader bar according to the invention, the spreader frame has a weight at least four times higher than the spreader bar according to the invention and is six times more expensive.

Figure 3:
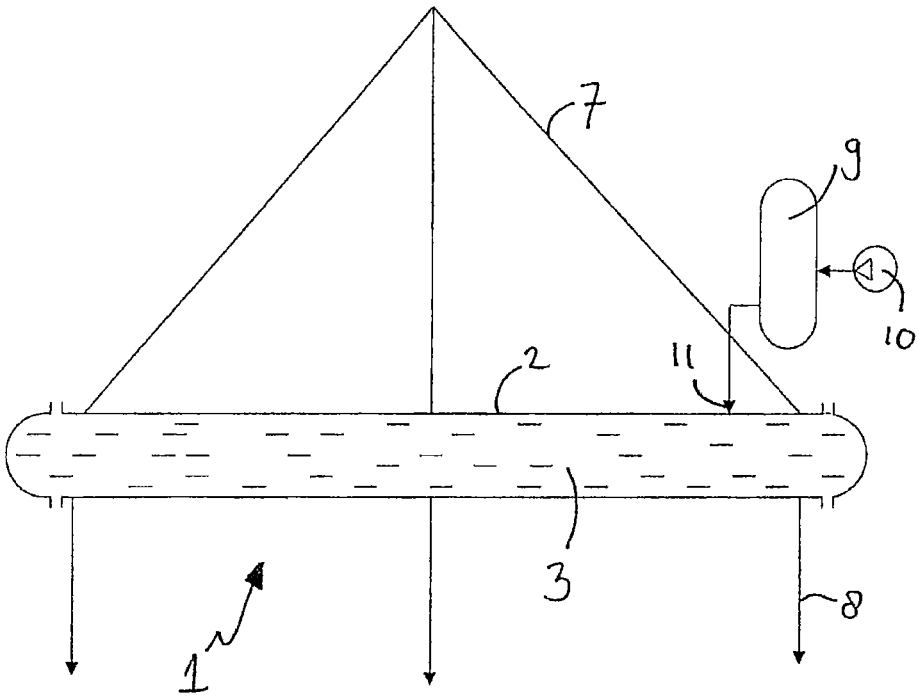
FIG. 3 schematically shows the structural element provided with a pressure vessel in cross-section.

In FIG. 3 a structural element in the form of a spreader beam 1 provided with a pressure vessel 9 is shown. The tube 2 is provided with a valve 11 extending into the core 3 of said tube 2. The valve 11 is connected to the vessel 9 by a supply line. In case the pressure in the core 3 drops, which can for instance be measured using pressure sensor provided in the core or in the valve 11, an additional amount of gas and/or liquid can be supplied to the core 3. Even if the core 3 has a leak, the strength of the tube 2 can be guaranteed long enough to be able to lower the structure being hoisted. This provides a fail-safe spreader bar. To further improve the safety, a pump 10 is provided to increase the pressure in the vessel 9 or for instance directly in the core 3 (not shown).

Figure 4:
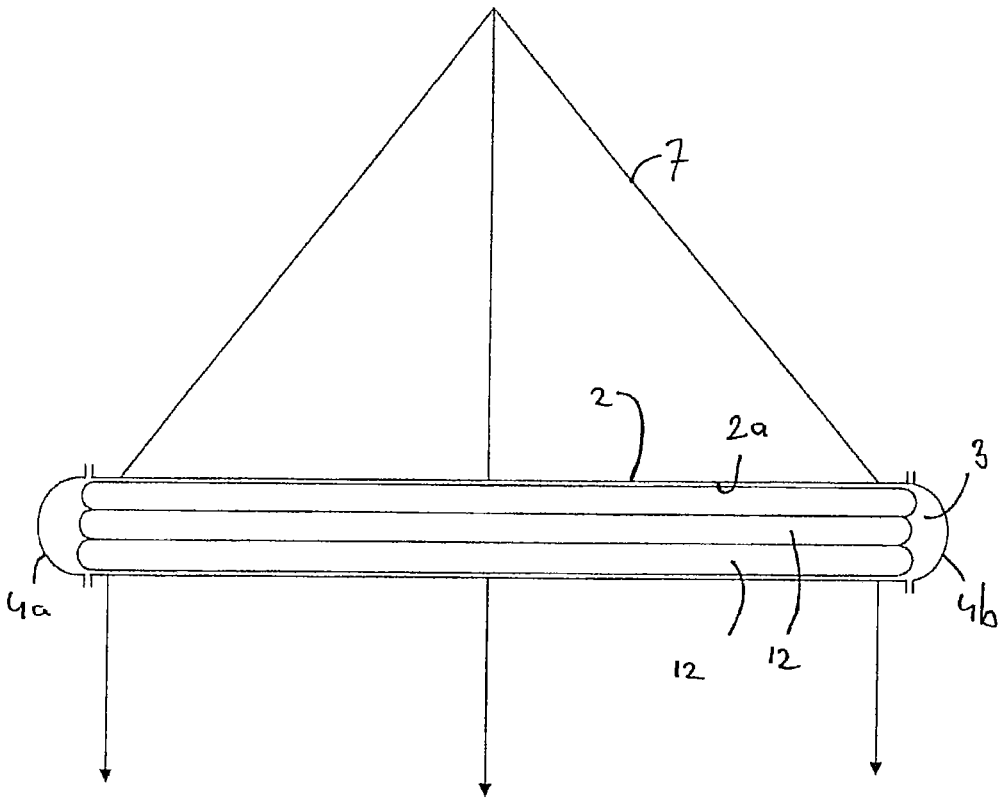
FIGS. 4-9 schematically show different embodiments of the spreader bar with compartments in cross-section.
Figure 5A:
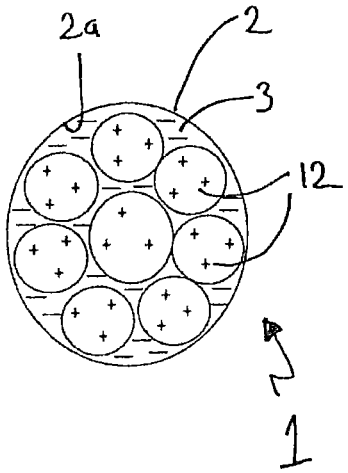

In FIG. 4 the structural element is provided with a plurality of compartments in the form of inner tubes 12 which extend in the core 3. The tubes 12 extend at a distance from the inner surface 2*a* as can be seen in the cross-sections of FIGS. 5*a* and 5*b* taken perpendicular to FIG. 4. This allows the fluid in the core 3 to exert a pressure on the inner surface 2*a* and side faces 4*a* and 4*b* of the tube 2. In FIG. 5*a* the core 3 is filled with a liquid under pressure, while the tubes 12 are filled with a gas under pressure. The tubes 12 are in this embodiment manufactured from airtight cloth. It is however also possible to manufacture the tubes 12 from a stiff material.

Figure 5B:
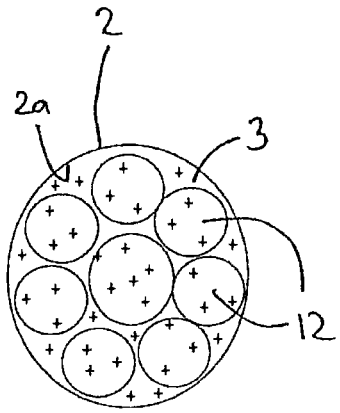

In the embodiment shown in FIG. 5*b* both the core 3 and the tubes 12 are filled with gas, the gas in the tubes not being pressurized. In this embodiment the tubes 12 are manufactured from a stiff material, in this case plastic.

Figure 6:
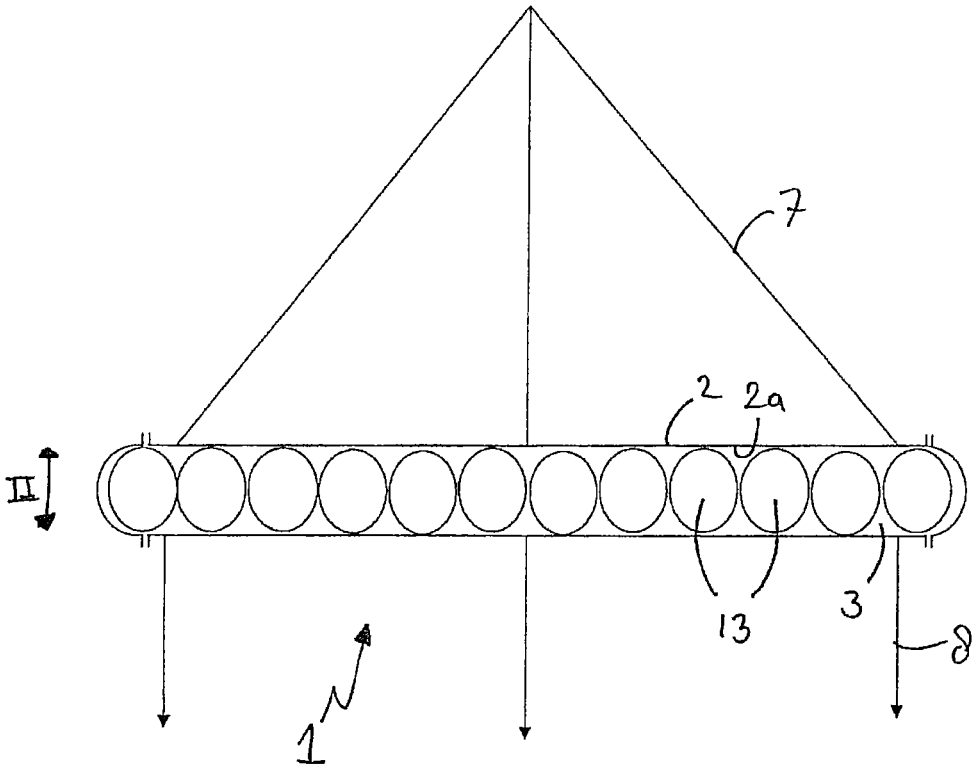
Figure 7:
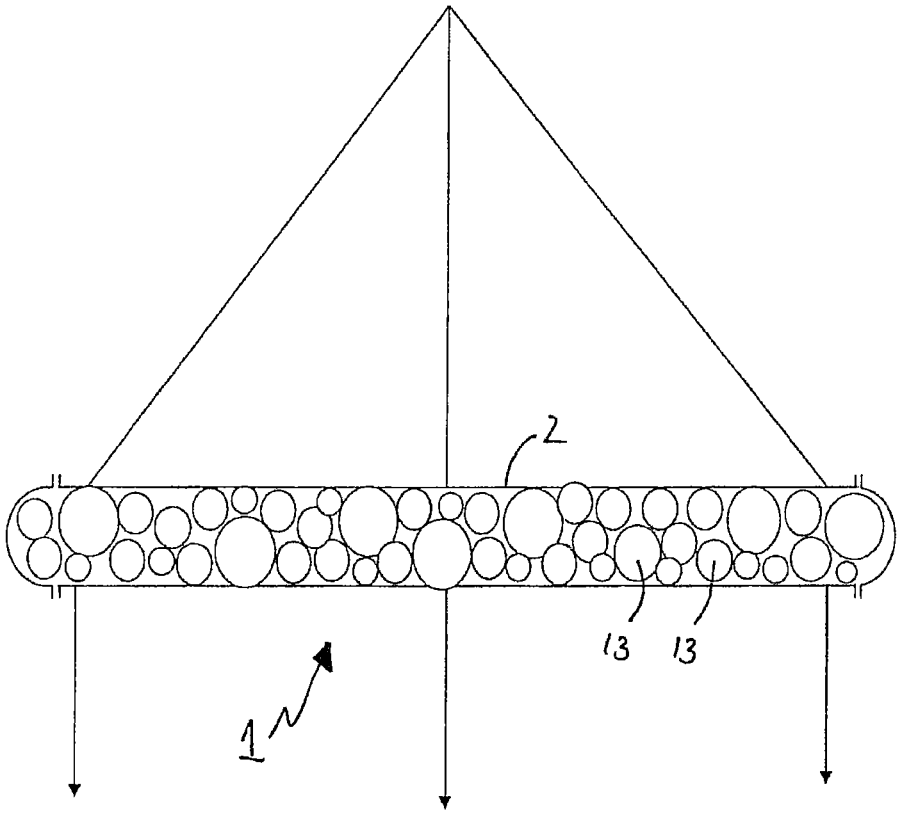

In FIG. 6 another embodiment is shown wherein the core 3 of the tube 2 comprises compartments in the form of a plurality of spheres 13. The spheres 13 extend along the longitudinal axis of the tube 2 and have a diameter corresponding to the diameter II of the tube 2 in order to achieve a proper fit of said spheres 3. A modification is shown in FIG. 7, wherein the compartments have varying sizes and shapes.

Figure 8:
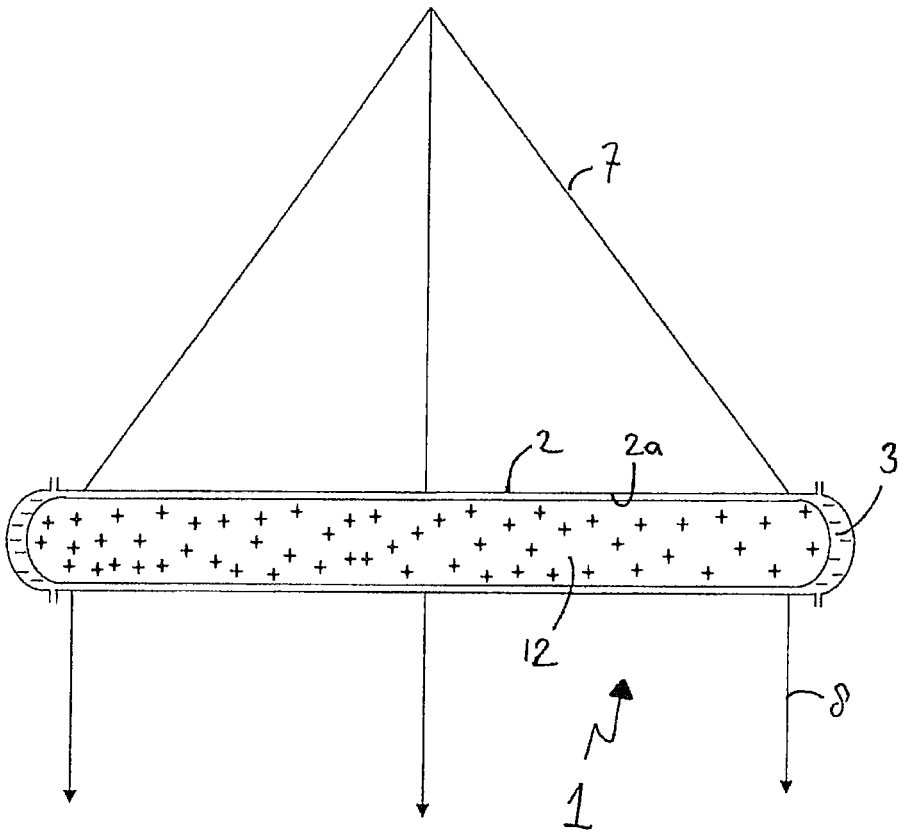

In FIG. 8 a spreader bar is shown having a single compartment in the form of a tube 12. The tube 12 extends coaxial to the tube 2 and has a diameter smaller than the diameter of the tube 2. This allows the gas in the core 3 to exert pressure on the whole inner surface of the inner wall 2*a* and side faces of the tube 2.

Figure 9:
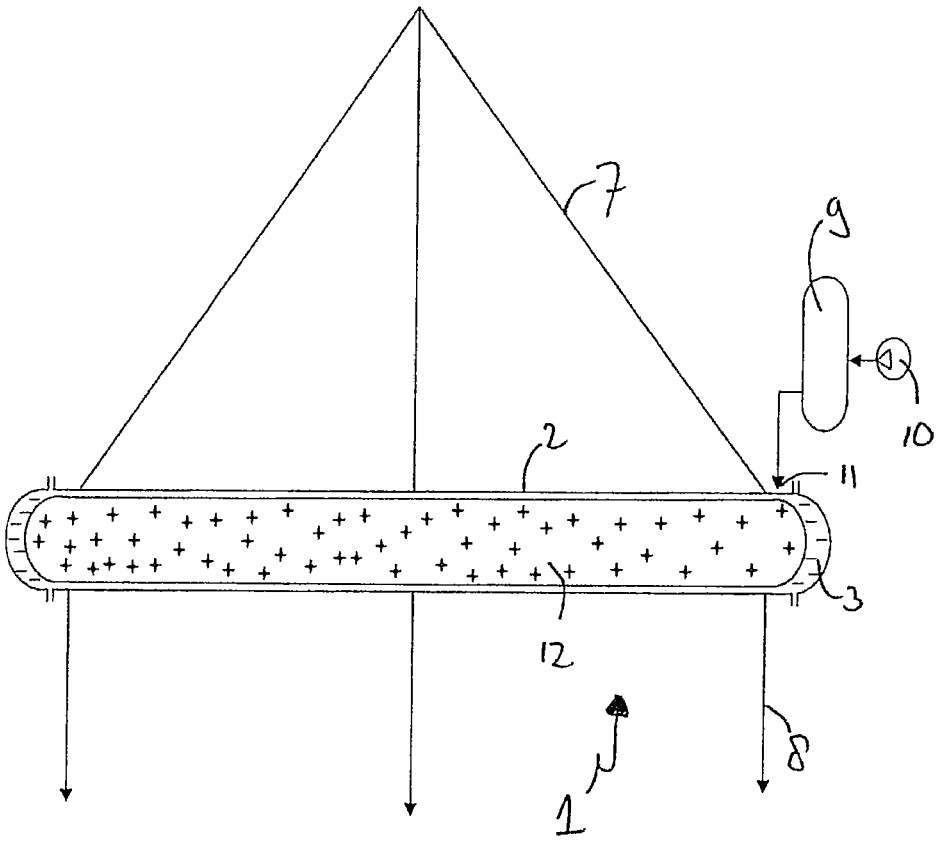

In FIG. 9 the spreader bar shown in FIG. 8 is provided with a pressure vessel 9 and a pump 10. The vessel 9 is arranged to supply additional pressure to the core 3. It is also possible to supply additional pressure to the tube 12 if needed.

Figure 10:
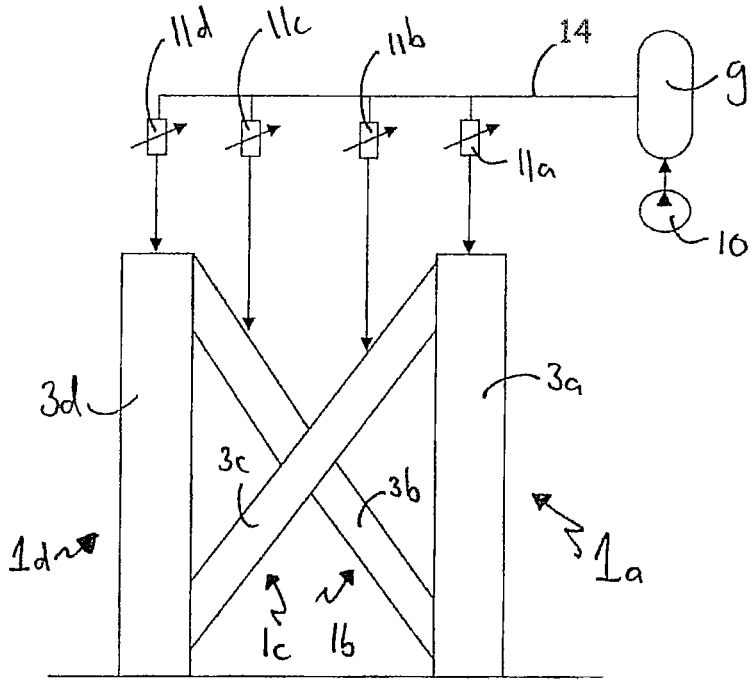
FIG. 10 schematically shows a structure according to the invention in cross-section.

In FIG. 10 a structure according to the invention is shown. The structure is manufactured from a plurality of structural elements 1*a-d* in the form of tubes. Each of the tubes is provided with a core 3*a-d*. The cores 3*a-d* are filled with a liquid under pressure. The cores 3*a-d* of each of the elements 1*a-d* are connected by valves 11*a-d* to a common supply line 14 for connection to a pressure vessel 9 provided with a pump 10. The structure is furthermore provided with a controller (not shown) for controlling the valves 11*a-d*.

If for instance one of the elements 1*a-d* is stressed, for instance due to a change in load, a deformation of the structure by for instance an earthquake or a collision with for instance a vehicle or a wave, the pressure in the core of said element can be adjusted to compensate for the change in stress. The pressure in a particular core can be increased up to the ultimate loading limit of said element, allowing the element to reach its maximum strength. In case one of the elements 1*a-d* is deformed or collapsed, the surrounding elements can be adjusted to compensate for the loss of one of the elements by increasing the pressure in the remaining cores 3*a-d*.

By changing the pressures in the cores, the natural frequencies and the damping of the structural elements, in particular the elements forming the structure, are changed. Next to changing the he static characteristics of the structure, this also allows changing the dynamic response of said structure. Resonance of the structure can hereby effectively be prevented, resulting in lower stresses and vibrations. The resulting fatigue damage is hereby significantly reduced.

In the structure of FIG. 10 the pressures in the cores 3*a-d* are adjusted actively. That is, a controller is arranged to adjust the pressures in said cores 3*a-d* bases on pressure measurements. Additional pressure can be supplied using the pump 10 or other suitable means.

It is also possible that a structure without pressure vessel 9 and pump 10 is used. The cores 3*a-d* are then interconnected using suitable lines. These lines can be provided with valves 11*a-d*. When one element, for instance element 1*a*, is stressed, the pressure in core 3*a* will rise. Due to the pressure difference between the cores, the overpressure in core 3*a* will be distributed to the other cores 3*b-d*, dependent on the switching of the lines. The pressures in the other cores 3*b-d* will therefore also rise, compensating for the load experienced by element 1*a*. The same applies in case the pressure drops in one of the cores 3*a-d*.

The present invention is not limited to the embodiment shown, but extends also to other embodiments falling within the scope of the appended claims. It should be noted that the features described for instance the structural element can also be applied to the structure according to the invention and vice versa. It is for instance possible to provide the cores of the structure with compartments.

The invention claimed is:

1. A structure comprising:

a supply line;

a plurality of valves; and at least two stiff, interconnected elongated tubular members, individual ones of said at least two stiff, interconnected elongated tubular members comprising an inner surface and a plurality of side faces that enclose a core extending along at least a length of said tubular member, wherein said core is coupled to said supply line through a corresponding one of said plurality of valves and said core is supplied with fluid under pressure, wherein the valve to which said core is coupled is dedicated solely to said core, and said plurality of valves share said supply line, further comprising a controller arranged to control said plurality of valves, wherein said controller is configured to provide independent pressure adaptation to said cores of said at least two elongated tubular members.

2. The structure according to claim 1, wherein said core extends substantially along an entire length of said individual ones of said at least two elongated tubular members.

3. The structure according to claim 1, wherein said fluid under pressure extends substantially along an entire length of said inner surface.

4. The structure according to claim 1, wherein said controller is arranged to adjust pressure of fluid in said core based on pressure measurements.

5. The structure according to claim 1, wherein the controller is configured to individually control each valve coupled to each core.

6. The structure according to claim 1, wherein said structure is configured for a liquid fluid.

7. The structure according to claim 1, wherein said side faces are positioned at opposed ends of the elongated tubular member.

8. The structure according to claim 1, wherein said fluid under pressure within said core has a pressure in a range from 0 Pa up to a maximum allowable circumferential stress of said at least two elongated tubular members.

9. The structure according to claim 8, wherein said fluid under pressure within said core is approximately half of said maximum allowable circumferential stress.

10. The structure according to claim 1, wherein said core is provided with a plurality of compartments.

11. The structure according to claim 10, wherein said plurality of compartments extends along substantially an entire length of said core.

12. The structure according to claim 1, wherein said core is provided with at least one compartment.

13. The structure according to claim 12, wherein said at least one compartment is substantially spherical in shape.

14. The structure according to claim 12, wherein said at least one compartment extends substantially along an entire length of said core.

15. The structure according to claim 12, wherein said at least one compartment is substantially tubular in shape.

16. A structure comprising:

a supply line;

a plurality of valves; and at least two stiff, interconnected elongated tubular members, individual ones of said at least two stiff, interconnected elongated tubular members comprising an inner surface and a plurality of side faces that enclose a core extending along at least a length of said tubular member, wherein said core is coupled to said supply line through a corresponding one of said plurality of valves and said core is supplied with fluid under pressure, wherein the valve to which said core is coupled is dedicated solely to said core, and said plurality of valves share said supply line, further comprising a controller arranged to control said plurality of valves, wherein said controller is arranged to adjust pressure of fluid in said core based on pressure measurements.

* * * * *